US006301714B1

(12) United States Patent
Son

(10) Patent No.: US 6,301,714 B1
(45) Date of Patent: Oct. 16, 2001

(54) UPPER GARMENT WITH AN INFLATABLE COLLAR

(76) Inventor: Keun Bae Son, 532, Kanglim-dong, Okpo-myun, Dalsung-gun, Kyongsangbuk-do (KR)

( * ) Notice: Subject to any disclaimer, the term of this patent is extended or adjusted under 35 U.S.C. 154(b) by 0 days.

(21) Appl. No.: 09/412,514

(22) Filed: Oct. 5, 1999

(51) Int. Cl.[7] ..... A41B 3/00
(52) U.S. Cl. ..... 2/129; 2/468; 2/DIG. 3
(58) Field of Search ..... 2/129, 69, 79, 2/456, 465, 468, DIG. 3, DIG. 10, 455, 131, 132, 133, 134, 135, 143; 297/391; 280/730.1, 730.2

(56) References Cited

U.S. PATENT DOCUMENTS 673,872 * 5/1901 Von Hillern-Flinsch ..... 2/468
1,657,866 * 1/1928 Mooney ..... 2/DIG. 3
3,855,631 * 12/1974 Ettinger ..... 2/DIG. 3
4,333,179 * 6/1982 Laurita ..... 2/2
5,091,992 * 3/1992 Pusic ..... 2/DIG. 3
5,133,084 * 7/1992 Martin ..... 2/DIG. 3
5,330,255 * 7/1994 Stawicki ..... 297/391
5,402,535 * 4/1995 Green ..... 2/468
5,937,443 * 8/1999 Kageyama et al. ..... 2/69
6,032,299 * 3/2000 Welsh ..... 2/456

* cited by examiner

*Primary Examiner*—Amy B. Vanatta

(57) ABSTRACT

An inflatable collar of an upper garment comprises a sealed cavity and an air cock communicating into the sealed cavity for injecting and discharging therethrough. The cavity may be formed by placing an arc shape tube with an air cock on the inner or outer side of the collar, or by making the collar with fiber or cloth coated with a sealing material. According to this invention, the collar inflated with air may surround and bolster the wearer's neck, functioning as an air pillow and alleviating the fatigue which may be caused to traveller due to a long time journey by a car, airplane or the like.

11 Claims, 8 Drawing Sheets

UPPER GARMENT WITH AN INFLATABLE COLLAR

BACKGROUND OF THE INVENTION

1. Field of the invention

This invention relates to an upper garment with an inflatable collar, more particularly to an upper garment with an air collar, which may be inflated into the shape of an air pillow with the air injected therein.

2. Description of the Prior Art

Long distance travelling by many kinds of carriers (for example, planes, trains or cars) requires travellers to stay on their seats for a long time and often causes some fatigue to their bodies, especially to their heads due to shaking of the carriers. Most seats are, of course, equipped with a headrest, but the headrest can bolster the boarder's neck only and hardly prevent his or her heads from being shaken. Accordingly, it is not so effective for prevention of the on board fatigue. Especially, even a delicate quaking or inclining of the carrier may cause intense shaking to the boarder who is sleeping with the neck unstably laid on the headrest or with the head on the back of the seat, which may disturb sleeping and thus leave considerable fatigue or pains in the neck or shoulders.

To solve the above problems, a pillow for travelling, what is called, is known in the art for keeping its wearer's head safe regardless of the carrier's rocking and presented to the airplane passengers for use during a long flight.

The Korean utility model laid-open no.87-14367 describes an example of the air pillows with the shape of the letter U. It can be carried and used without difficulty just by injecting air thereinto and wearing it around the neck during the flight or journey. That is, the user may lean against the back of the seat with the air pillow being worn around the neck and held against the seat back or the headrest, thus resisting the carrier's rocking and keeping his or her head safely and comfortably.

However, as the air pillow 1 of the art is a particular article or merchandise, we have to be nervous about carrying it without failure and/or inadvertently losing it.

SUMMARY OF THE INVENTION

This invention has been made to solve those problems mentioned in the above. It is an object of the present invention to provide an upper garment with a collar which may function as an air pillow, just by injecting air into the collar to safely bolster the wearer's neck and/or head against the back or headrest of the seat.

It is another object of the invention to eliminate the necessity of carrying a particular air pillow for use in travelling by cars or airplanes. To attain the above objects, an upper garment with an inflatable collar formed with a sealed cavity and at least an air cock is provided by the present invention.

According to an aspect of the present invention, the collar itself is made of a sealing-treated fiber or cloth which forms a cavity therein.

According to another aspect of the present invention, the cavity in the collar is provided by a tube with an air cock, mounted in or on the collar. The inflatable collar of the upper garment according to the present invention may be transformed into an air pillow, as air is injected into the cavity therein and used to bolster the wearer's neck and head against the back or headrest of the seat in the car, airplane, etc. so that the traveller's fatigue may be alleviated.

BRIEF DESCRIPTION OF THE DRAWINGS

The detailed characteristics and other benefits will be better understood from the following detailed description of some preferred embodiments of the invention in conjunction with the accompanying drawings in which.

DETAILED DESCRIPTION OF THE INVENTION

Figure 1:
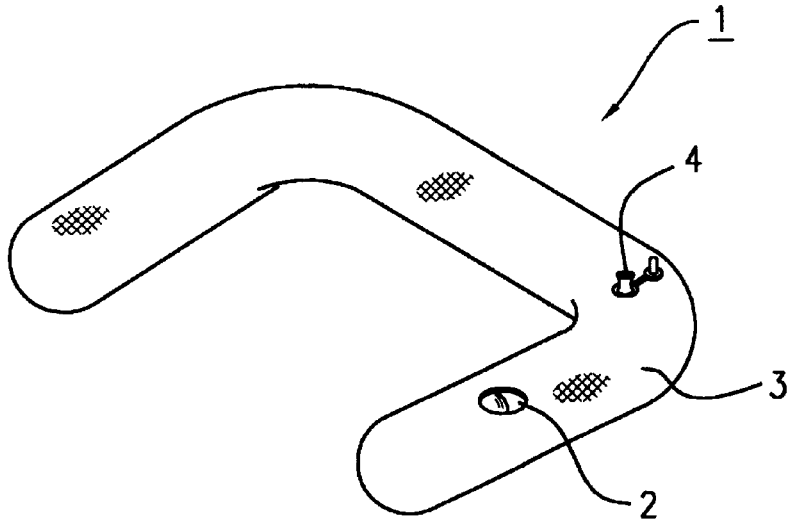
(PRIOR ART) FIG.1
FIG. 1 is a perspective view of an air pillow.

FIG. 1 shows an air pillow disclosed in the Korean Utility Model Laid-open No.87-14367 in the shape of a tube 3 formed by a cloth of sealing material and provided with an air cock for injecting and blowing out the air.

Figure 2:
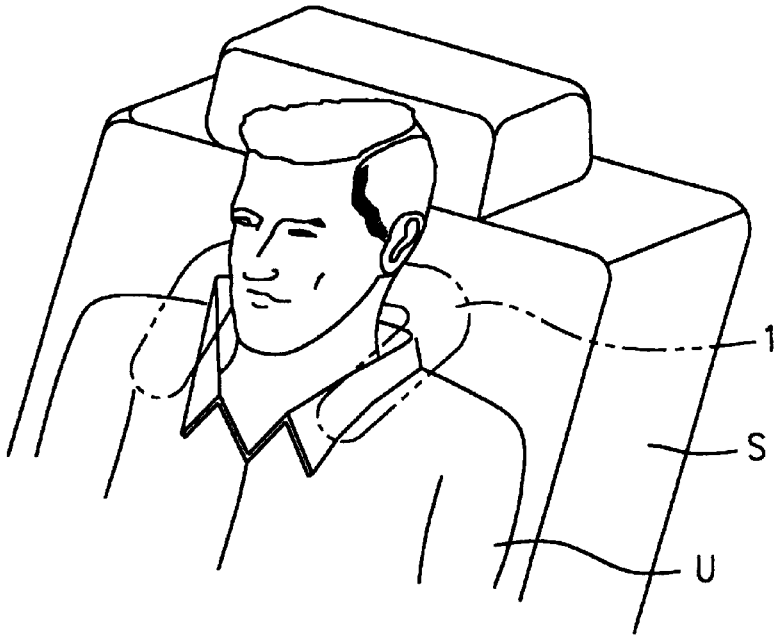
(PRIOR ART) FIG.2
FIG. 2 shows the air pillow of FIG. 1 in use.

The air pillow of FIG. 1 may be worn around the neck for placing the neck and head of the user U safely on the back and/or headrest of the seat S as shown in FIG. 2.

Figure 3:
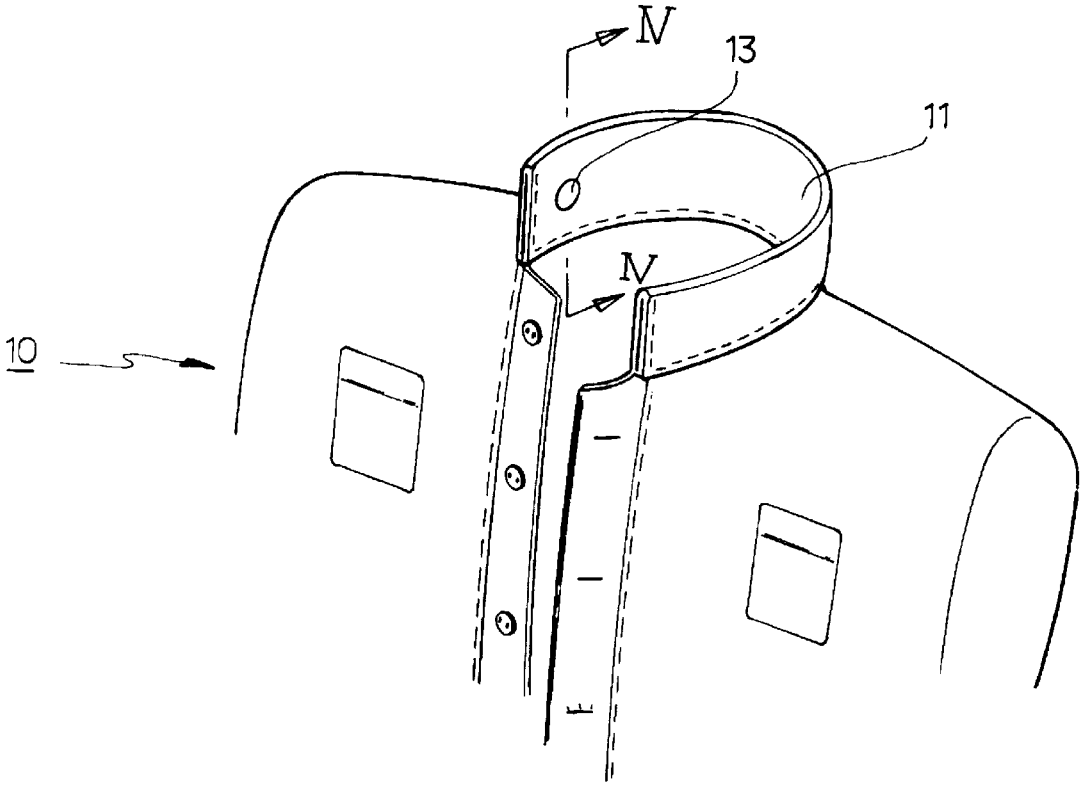
FIG. 3 is a perspective view of an upper garment with an inflatable collar according to a first preferred embodiment of the present invention
Figure 4A:
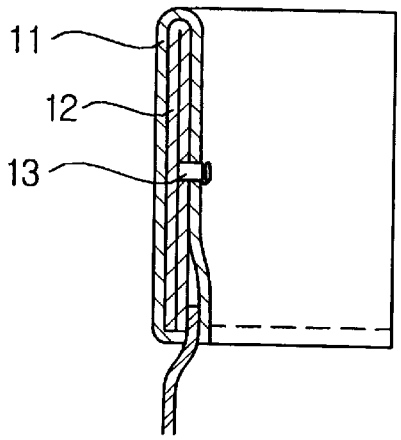
FIG. 4*a* is a sectional view of the collar taken along line 4—4 of FIG.
Figure 4B:
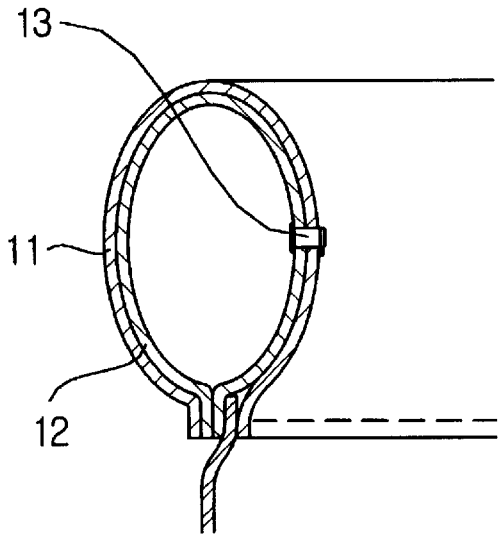
FIG. 4*b* is a sectional view of the collar of FIG. 4*a* with the air injected therein.
Figure 5:
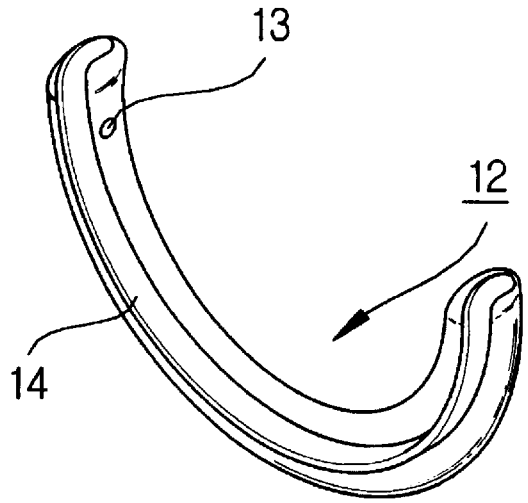
FIG. 5 is a perspective view of a tube extracted from the collar of FIG. 3
Figure 6:
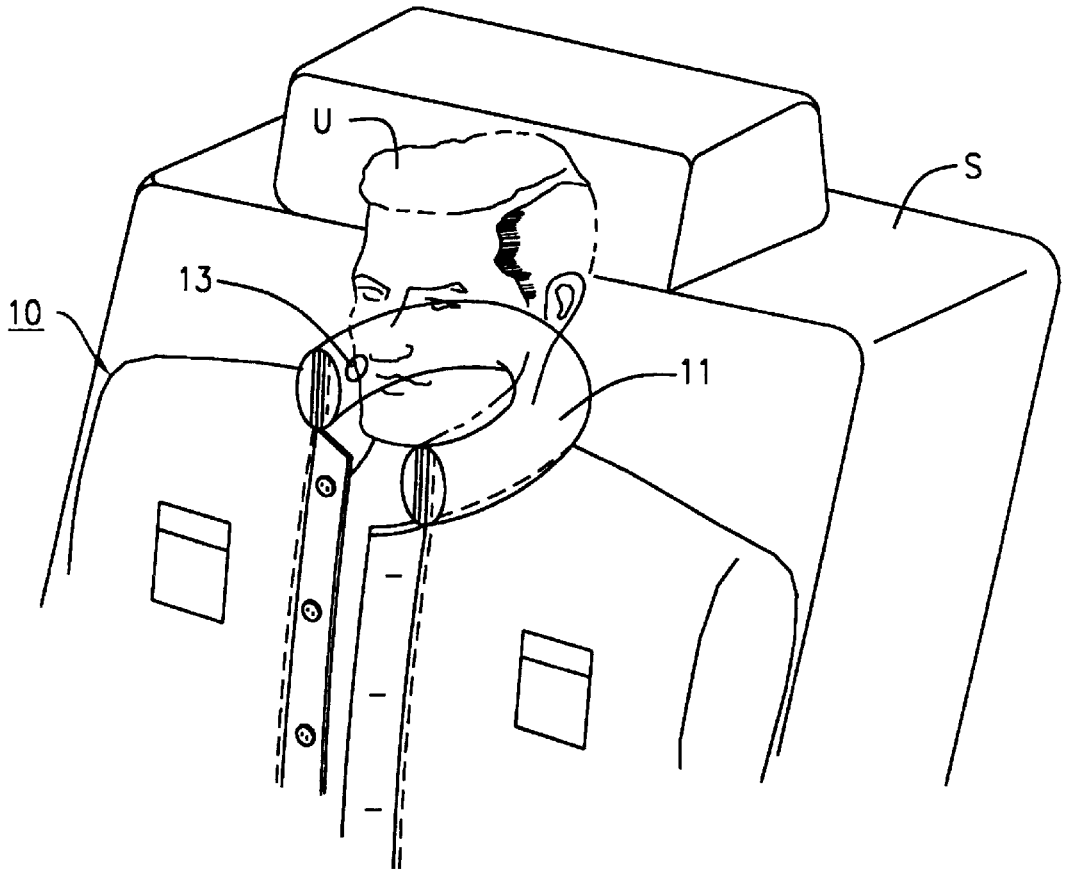
FIG. 6 shows the upper garment with the collar inflated with air which is worn by a man leaning against the back of the airplane seat.

FIGS. 3 to 5 illustrate an upper garment 10 with an inflatable collar 11 according to a first embodiment of the present invention, comprising a plastic tube 12 formed in the collar 11, wherein the air may be injected into or blown out from the tube 12. The long tube 12 has a circular shape in section with a proper curvature to cope with the size and the shape of the collar 11, equipped with a known air cock which is extended through and exposed out of the collar 11.

The tube 12 can be placed in the cavity formed by the collar 11, but it is desirable that a margin of the tube 12, preferably its both ends parts, is sewn up together with a corresponding part of the collar 11 for safe keeping of the tube in the cavity of the collar.

Besides, the size of the collar 11 is recommended to be designed larger than the ordinary one, so that it may have a proper size to surround and bolster the neck and thus fulfill the role of an air pillow while in use. Therefore, this embodiment is suitable for safari jackets with a collar 11 bigger than the usual clothing.

This kind of jacket is to be worn with the flat collar 11 with air injected therein, when not in use as a pillow. In that case, the flat collar 11 does not cause any inconvenience in wearing the jacket or working with the jacket on, as shown in FIG. 4*a*.

On the other hand, for using during a long journey in a car or airplane, the air may be injected into the tube 12 of the collar 11 through the air cock 13, with the jacket worn or not. Thus the tube 12 will be inflated with the air injected thereinto, turning the collar to air pillow in an arc shape so that the collar 11 may surround and bolster the boarder's neck. Thus, the collar 11 of the upper garment 10 may keep the boarder's neck against the back or headrest of the seat comfortable while on board, which may diminish the boarder's fatigue, suppressing the shaking of the boarder's head.

FIG. 7 and 8 illustrate an upper garment 10 with an inflatable collar according to a second preferred embodiment of the invention. It is formed with an incision part on the rear side of the collar 11 in such a length as to pull the tube 12 out of the collar 11 through the opening. The incision part or opening may be provided with an opening means like a zipper 15 or a Velcro. In this case, a part of the tube 12 is fixed on the collar 11 and there's no need to mount the air cock 13 of the tube 12 on the collar 11, differently from the first embodiment of the invention.

Figure 7A:
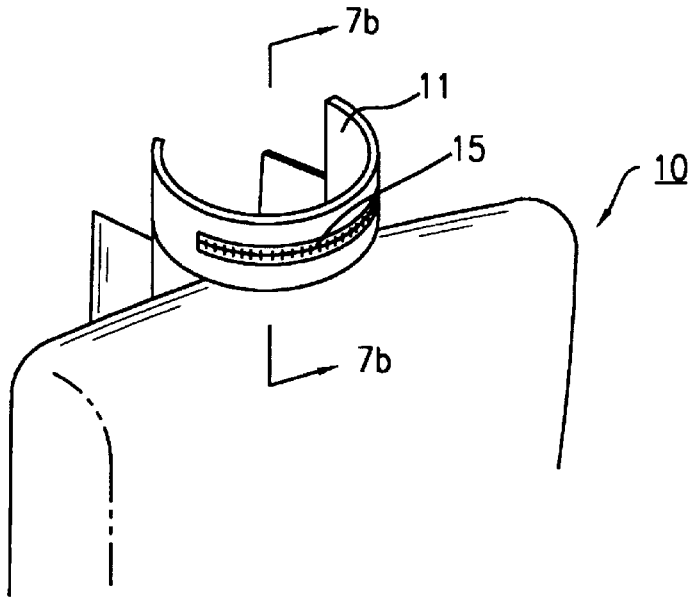
FIG. 7*a* is a rear perspective view of an upper garment with an inflatable collar according to a second preferred embodiment of the present invention.
Figure 7B:
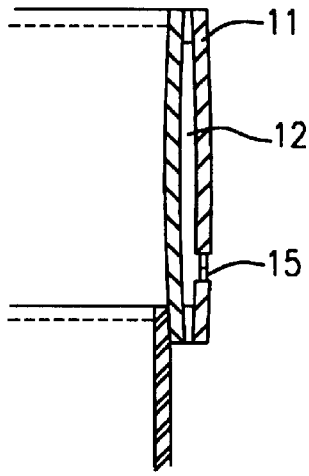
FIG. 7*b* is a sectional view of the collar of FIG. 7*a* with a tube therein.
Figure 8A:
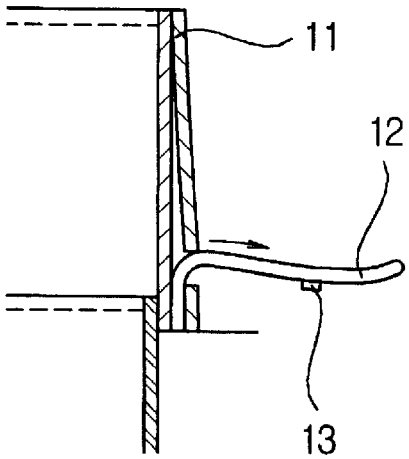
FIG. 8*a* shows the tube of FIG. 7*b* drawn out of the cavity in the collar.
Figure 8B:
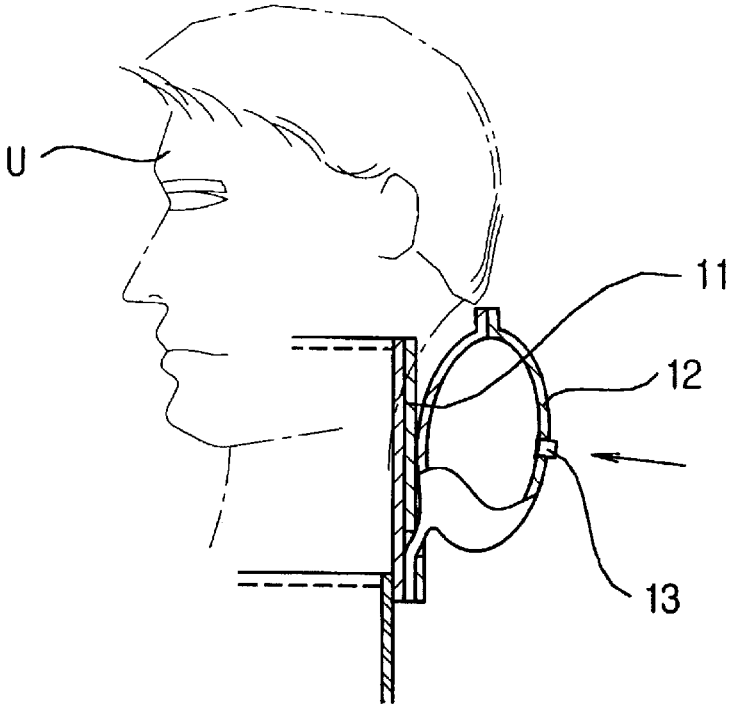
FIG. 8*b* is a cutaway view of the collar inflated with air.

According to the second embodiment of the invention, the tube 12 may be put in the collar 11 which may be then zipped up by the zipper 15, after the air therein has been discharged, so that the upper garment 10 may be used as an ordinary one, as shown in FIGS. 7*a* and 7*b*. The tube 12 may be drawn out of the collar 11 unzipped and opened with the zipper 15 as shown in FIG. 8*a* and air is injected into the tube 12 by the air cock 13 as shown in FIG. 8*b*. Thus the tube 12 is inflated, girding the user's neck without being separated from the collar 11, which makes the tube 12 not to contact the wearer's neck directly and thus the wearer not to feel the touch of the tube material.

Figure 9A:
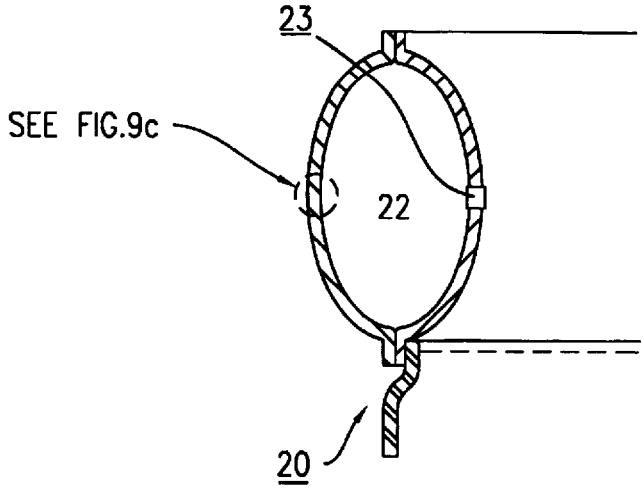
FIG. 9*a* is a sectional view of a collar of an upper garment according a to third embodiment of the invention.
Figure 9C:
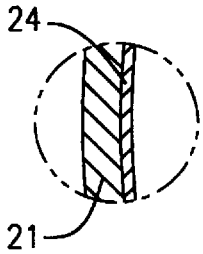
FIG. 9*b* is a sectional view of the collar of FIG. 9*a* with the air injected therein.
Figure 9B:
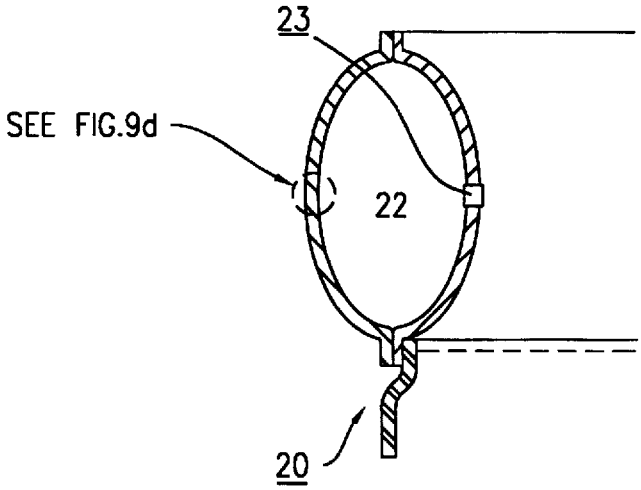
Figure 9D:
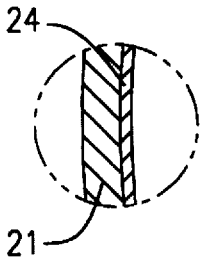

A third embodiment of an upper garment with an inflatable collar is illustrated in FIGS. 9*a* and 9*b*. In this embodiment, the collar 11 itself functions as a tube with a cavity 22 therein, provided with an air cock 23 on one side of the collar 21. The collar 21 of this embodiment is made of a sealing-treated fiber or cloth for the prevention of air leakage. Among sealing materials, nylon, urethane or silicone resin is preferably recommended.

The third embodiment of the invention may have the same effect at that of the first and second embodiments without an extra tube provided inside the collar 21.

Figure 10A:
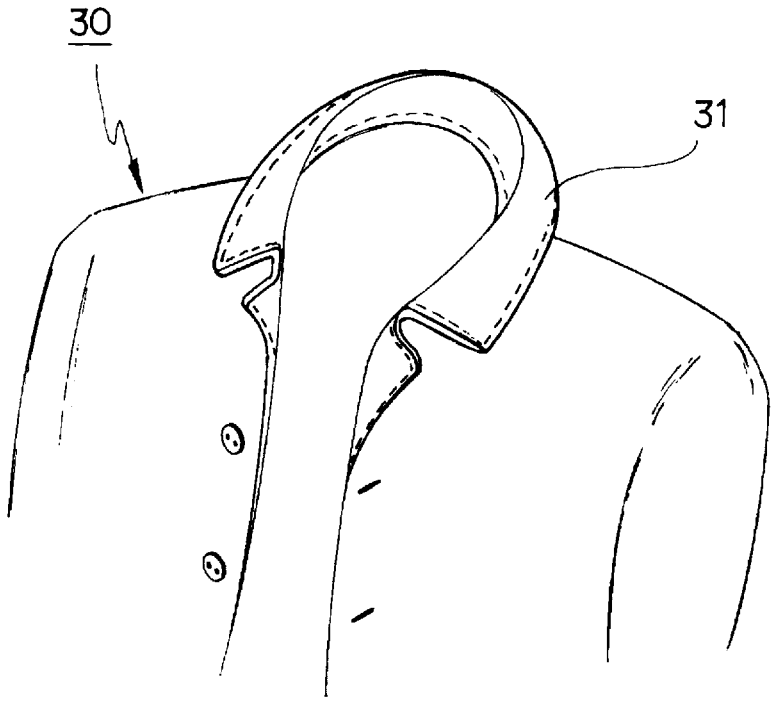
FIG. 10*a* is a perspective view of an upper garment with an inflatable collar according to a fourth embodiment of the invention.
Figure 10B:
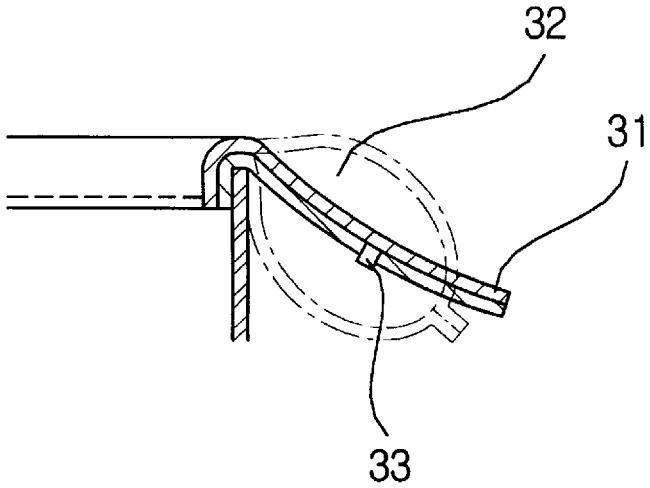
FIG. 10*b* illustrates collar of FIG. 10*a* in section.

An upper garment 30 according to the present invention may have a double-layer collar as shown in FIG. 10*a*. As in the previous embodiments, if air is injected into a cavity 32 of the collar 31 through an air cock 33, the collar 32 may inflate and surround the user's neck as shown in FIG. 10*b* in an one-dot chain line so as to be used as an air pillow.

Though not shown in the drawing, the outer layer of the collar can be replaced by a tube, and the inner layer of the collar made of a natural fiber may contact the user's neck, which does not give any uncomfortable touch or feeling to the user.

Though the present invention has been described by means of the embodiments for the upper garments with a single-layer collar, those embodiments were presented as examples and therefore, the present invention is not limited to those examples.

What is claimed is:

1. A garment with an inflatable collar, said garment comprising:

a neck portion;

a collar attached to said neck portion of said garment, said collar having an enclosed cavity;

an inflatable tube completely enclosed in said collar and having a dimension suitable to comfortably support the wearer's head and neck against a headrest of a chair when said tube is inflated; and an air cock communicating into said tube for injecting and discharging air, wherein said tube is manually inflated through said air cock.

2. The garment of claim 1, wherein said cavity is formed by an air impervious fiber or cloth material.

3. The garment of claim 2, wherein said air impermeable material is a fiber or cloth material treated with a sealing material selected from the group consisting of nylon, urethane and silicone resins.

4. The garment of claim 1, wherein said air cock is positioned on an inner face of said collar.

5. The garment of claim 1, wherein said collar is formed from a sheet material having longitudinal edges coupled together and attached to said neck portion.

6. The garment of claim 1, wherein said inflatable tube comprises an air impervious sheet material having longitudinal edges, wherein said longitudinal edges of said sheet material are coupled together to form said inflatable tube and are attached to said neck portion of said garment.

7. A garment for supporting the head and neck of a wearer, said garment comprising:

a neck portion for surrounding the neck of a wearer;

an outer collar attached to said neck portion, said collar formed from a sheet material having longitudinal edges coupled together to form a substantially closed cavity;

an inflatable tube disposed completely within said cavity of said collar, said tube being inflatable from a collapsed form to an inflated form to fill said cavity and expand said collar, said collar and tube having an inflated dimension to support the head and neck of a wearer comfortably against a headrest of a chair; and an air cock coupled to said tube for manually inflating and deflating said tube, said air cock extending through said collar.

8. The garment of claim 7, wherein said longitudinal edges of said outer collar are attached to said neck portion of said garment.

9. The garment of claim 8, wherein said inflatable tube is attached to said neck portion of said garment.

10. The garment of claim 8, wherein said tube is formed from a sheet material having longitudinal edges coupled together and attached to said neck portion of said garment.

11. The garment of claim 10, wherein said longitudinal edges of said tube are coupled to said longitudinal edges of said collar.

* * * * *